US005487280A

United States Patent [19]

D'Amore, Jr.

[11] Patent Number: 5,487,280

[45] Date of Patent: Jan. 30, 1996

[54] CONVERTIBLE EARRING

[75] Inventor: William D'Amore, Jr., West Warwick, R.I.

[73] Assignee: Cotillion, Inc., West Warwick, R.I.

[21] Appl. No.: 318,907

[22] Filed: Oct. 4, 1994

[51] Int. Cl.[6] ..... A44C 7/00

[52] U.S. Cl. ..... 63/12; 63/14.5

[58] Field of Search ..... 63/12, 14.1, 14.3, 63/14.4, 14.5

[56] References Cited

U.S. PATENT DOCUMENTS

| | | | |
|---|---|---|---|
| 782,313 | 2/1905 | Zirinsky | 63/12 |
| 1,034,254 | 7/1912 | Knoll | 63/14.4 |
| 2,501,754 | 3/1950 | Battiste | 63/14.5 |
| 2,510,511 | 6/1950 | Mittendorf | 63/14.3 |
| 2,813,407 | 11/1957 | Arzt . | |
| 2,945,363 | 7/1960 | Catildi | 63/14.5 |
| 3,122,007 | 2/1964 | Horland . | |
| 3,208,239 | 9/1965 | Pintarelli | 63/12 |
| 4,003,216 | 1/1977 | Cecere | 63/12 |
| 5,433,089 | 7/1995 | Timbal | 63/12 |

FOREIGN PATENT DOCUMENTS

| | | | |
|---|---|---|---|
| 1303574 | 8/1967 | France | 63/145 |

*Primary Examiner*—Flemming Saether
*Attorney, Agent, or Firm*—Salter & Michaelson

[57] ABSTRACT

A convertible earring of the present invention is capable of being selectively used as a clip-on earring or a pierced earring. The earring includes an ornament and a clamping assembly for resiliently clipping the earring on the earlobe of the wearer when the earring is in its clip-on mode. A post is pivotally mounted on the ornament and movable between a stowed position in which the post lies flat in a plane generally parallel to the plane of the ornament, to a use position in which the post extends generally perpendicularly from the ornament for insertion through a pierced opening in the wearer's earlobe. When the post is in its use position, the clip portion is movable to its earlobe clamping position for engaging the free end of the post.

1 Claim, 3 Drawing Sheets

CONVERTIBLE EARRING

BACKGROUND AND SUMMARY OF THE INVENTION

This invention relates generally to earrings and more particularly to a convertible earring capable of being attached to pierced and non-pierced earlobes.

Earrings capable of being used both as a conventional clip-on earring and for pierced ears have been available for some time. U.S. Pat. Nos. 2,813,407 (Arzt) and 3,122,007 (Horland) disclose earrings of this type. Both of these patents show an earring having a clip arm for clipping the earring on an earlobe, and a separate pin or post which is attached to the earring for converting it for use on a pierced earlobe. In the Horland patent, an aperture in the clip arm receives the end of the pin or post to function as a clutch member.

A significant disadvantage associated with the foregoing convertible earrings is that the pin or post is a separate member and must be attached to the earring in order to convert it for use with pierced ears. Since the pin or post is relatively small, there is a risk that it may be lost or misplaced. There is also a risk that the pin may become loose and fall off of the earlobe of the wearer since it is not permanently affixed to the earring.

The present invention overcomes these disadvantages associated with prior convertible earrings by providing a convertible earring capable of being selectively attached to a pierced ear and a non-pierced ear. In a preferred embodiment, the earring comprises an ornament having an inwardly facing surface which is adjacent an earlobe of a wearer when the earring is worn, and a clamping assembly for clipping the earring on the earlobe of the wearer. The clamping assembly is pivotally attached to the inwardly facing surface of the ornament and comprises a clip portion pivotally movable between an open position and an earlobe clamping position in which the earlobe of the wearer is positioned between the clip portion and the inwardly facing surface of the ornament. Spring means biases the clip portion toward the ornament when the clip portion is in its earlobe clamping position for providing a clamping force so that the earring remains attached to the earlobe when worn.

A post is pivotally mounted on the inwardly facing surface of the ornament and is movable between a stowed position in which the post lies flat in a plane generally parallel to the plane of the ornament so that it is substantially out of the way for enabling the wearer to clip the earring on the earlobe, to a use position in which the post extends generally perpendicularly from the ornament for insertion through a pierced opening in the wearer's earlobe. When the post is in its use position, the clip portion is movable to its earlobe clamping position for securing the free end of the post and is biased against the earlobe by the spring means for preventing the removal of the earring from the pierced earlobe of the wearer.

Also in a preferred embodiment, the clip portion has an opening formed therein which receives the free end of the post therethrough for preventing the unwanted removal of the earring from the pierced earlobe. Moreover, the post is pivotally attached to the ornament by a hinge connection in which the post has an eyelet formed at one of its ends which receives a member of the ornament therethrough for hingedly connecting the post to the ornament. On the inwardly facing surface of the ornament, there are ridges formed thereon which frictionally engage the wearer's earlobe to assist in preventing the earring from slipping off the wearer's earlobe when the earring is used in its clip-on mode.

Accordingly, among the several objects of the present invention are the provision of an improved convertible earring capable of being attached to pierced and non-pierced earlobes; the provision of such an earring which is capable of easily converting between a clip-on earring and a pierced earring without having to mount a separate piece onto the earring; the provision of such an earring which is durable; and the provision of such an earring which is simple in design, and easy to construct and assemble.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 8:
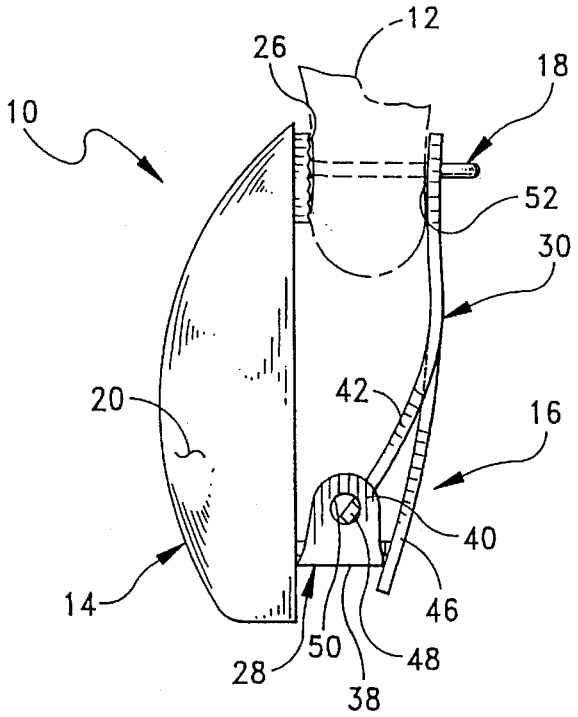
FIG. 8 is a side elevational view of the earring as it is worn on a pierced ear which is illustrated in broken lines.

Referring now to the drawings, there is generally indicated at 10 a convertible earring of the type adapted to be clipped onto an earlobe 12 (see FIGS. 2 and 8) of a wearer having a non-pierced earlobe or through a pierced earlobe. The earring 10 comprises a decorative ornament generally indicated 14, a clamping assembly generally indicated at 16, which is pivotally attached to the ornament 14, and a post generally indicated 18, which also is pivotally attached to the ornament 14. As mentioned briefly above, the earring 10 is easily convertible for selectively securing it to the earlobe 12 of the wearer as a clip-on earring (FIG. 2) or through a pierced hole provided in the earlobe (FIG. 8).

When the earring 10 is worn, the ornament 14 has an outwardly facing surface 20 which is exposed and an inwardly facing concave surface 22 which is adjacent the earlobe 12. It is to be understood that the ornament 14 may embody any of a number of different and varying designs and not just the design illustrated in the drawings. The ornament 14 further includes a mounting block 24 and an earlobe engaging member 26, each being located on the inwardly facing surface 22. As shown, the mounting block 24 is diametrically spaced from the earlobe engaging member 26.

It will be noted that the concavity of surface 22 permits block 24 and member 26 to sit substantially within the cavity defined by said concave surface, which permits the most effective positioning of the clamping and post assemblies hereinafter described, as opposed to the situation where the inner surface of the ornament is flat, which would cause the clamping and post assemblies to be positioned too far from the ornament inner surface.

The clamping assembly 16, which is well known in the art, comprises a bracket generally indicated at 28 mounted on the ornament 14, and a clip portion generally indicated at 30 pivotally attachable to the bracket 28. The clip portion 30 is effective to enable the earring 10 to frictionally grip the earlobe 12 by positioning the earlobe 12 between the clip portion 30 and the ear engaging portion 26. The bracket 28 and the clip portion 30 may be fabricated from any suitable rigid material, preferably metal. The bracket 28 includes a first leg 32 which is fixedly attached to the mounting block 24 of the ornament 14 by any suitable means such as adhesive or cement, and a second leg 34 having opposite inner and outer surfaces 36, 38 and a pair of laterally spaced-apart wings, each indicated at 40. As shown, the second leg 34 extends away from the first leg 32 at a right angle.

Figure 1:
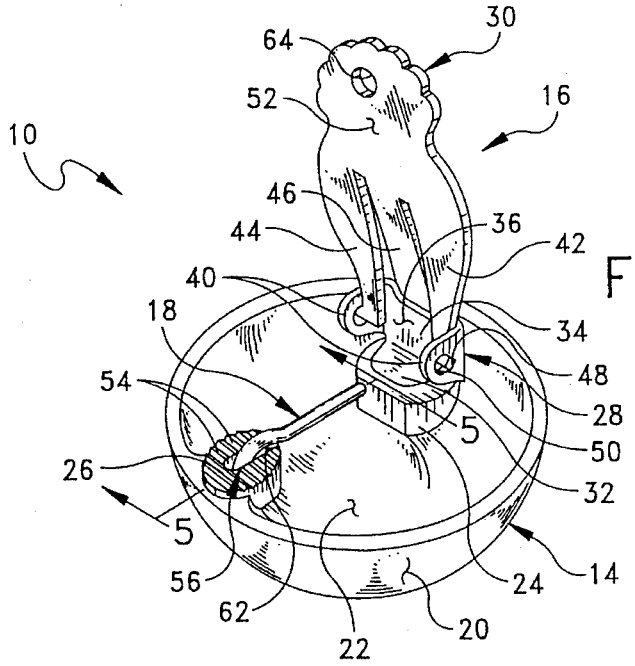
FIG. 1 is a perspective view of a convertible earring of the present invention.

As illustrated throughout the drawings, the clip portion 30 has three downwardly extending arms 42, 44 and 46, the outer two arms 42, 44 each having outwardly extending lugs 48 which are received through respective apertures 50 provided in each wing 40 of the second leg 34 of the bracket 28. This construction allows for the pivotal movement of the clip portion 30 with respect to the ornament 14 and the bracket 28 between an open position (FIGS. 1 and 3) and an earlobe clamping position (FIGS. 2 and 4) in which the earlobe 12 is positioned between the clip portion 30 and the earlobe engaging member 26 of the ornament 14.

The inner arm 46 of the clip portion 30 functions as an integrally struck spring which extends downwardly and bears against the outer surface 38 of the second leg 34 so as to provide a resilient clamping force (broadly referred to as "spring means") when the clip portion 30 is swung towards the ornament 14. The free end of the clip portion includes a bearing surface 52 which is adapted to engage the earlobe engaging surface 26, or the earlobe 12 of the wearer when the earring 10 is worn, due to the clamping force provided by the spring 46 of the clip portion 30 which biases the clip portion 30 toward the ornament 14. This clamping force ensures that the earring 10 remains attached to the earlobe 12 when the earring is worn. The earlobe engaging member 26 of the ornament 14 has ridges 54 formed thereon which frictionally engage the wearer's earlobe 12 to assist in preventing the earring 10 from slipping off the wearer's earlobe.

It should be understood that any clamping assembly suitable for clipping the earring onto a wearer's earlobe may be used and that the earring 10 of the present invention should not be limited to the clamping assembly 16 illustrated in the drawings.

As illustrated throughout the drawings, the post 18 is pivotally attached to the ornament 14 on the earlobe engaging member 26 of the ornament 14. Like the clip portion 30 of the clamping assembly 16, the post 18 is pivotally movable between a stowed position (FIGS. 1 and 2) in which the post 18 lies flat in a plane generally adjacent and parallel to the plane of the ornament 14, and a use position (FIGS. 3 and 4) in which the post 18 extends generally perpendicularly from the ornament 14. Referring particularly to FIG. 5, the post 18 is pivotally attached to the ornament 14 by a hinge connection, generally indicated at 56, in which the post 18 has an eyelet 58 formed at one of its ends, the eyelet 58 receiving pin means 60 of the ornament 14 therethrough for hingedly connecting the post 18 to the ornament 14. In its stowed position, the post 18 extends toward block 24 but terminates short thereof so as to be within the periphery of ornament 14 and hence out of the way for enabling the wearer to use the earring 10 as a conventional clip-on earring. A semi-cylindrically-shaped groove 62 formed in the earlobe engaging member 26 is provided for receiving a portion of the post 18 therein when it is in its stowed position for recessing the post 18.

Figure 6:
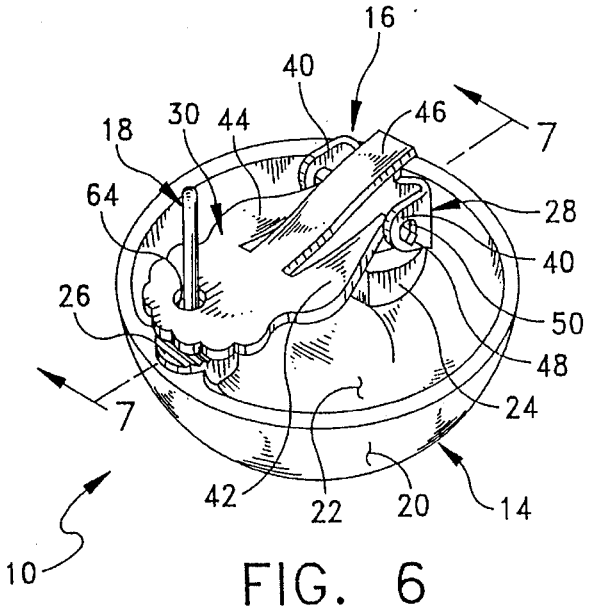
FIG. 6 is a perspective view of the earring as illustrated in FIG. 4.
Figure 7:
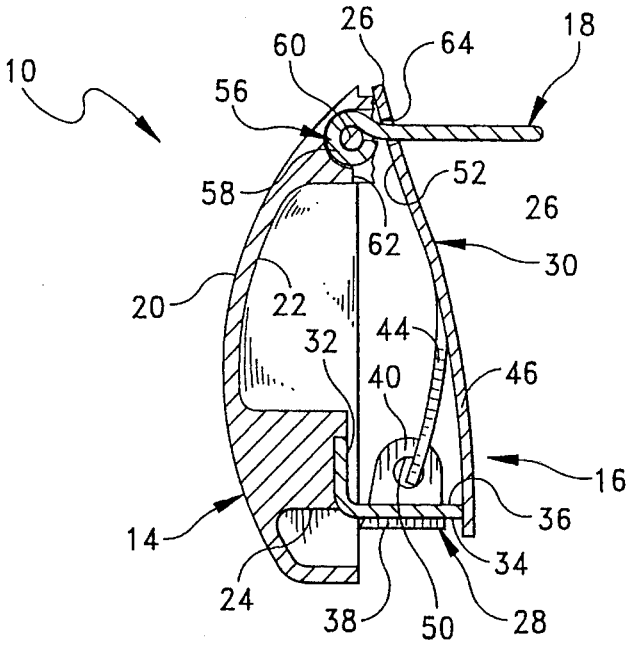
FIG. 7 is a sectional view taken along line 7—7 of FIG. 6.

When the post 18 is in its use position so that it extends through the pierced earlobe 12 (FIG. 8), the clip portion 30 of the clamping assembly 16 is movable to its earlobe clamping position for securing the free end of the post 18 in a similar manner to an earring clutch or backing which is well-known in the art of pierced earrings. The clip portion 30 is biased against the earlobe 12 by spring 46 of the clip portion 30, for preventing the inadvertent removal of the earring 10 from the pierced earlobe 12 of the wearer. More specifically, there is an opening 64 formed in the bearing surface 52 of the clip portion 30 which receives the free end of the post 18 therethrough for securing the earring 10 to the earlobe 12. FIGS. 6–8 illustrate how the post 18 is received by the opening 64 of the clip portion 30.

Figure 2:
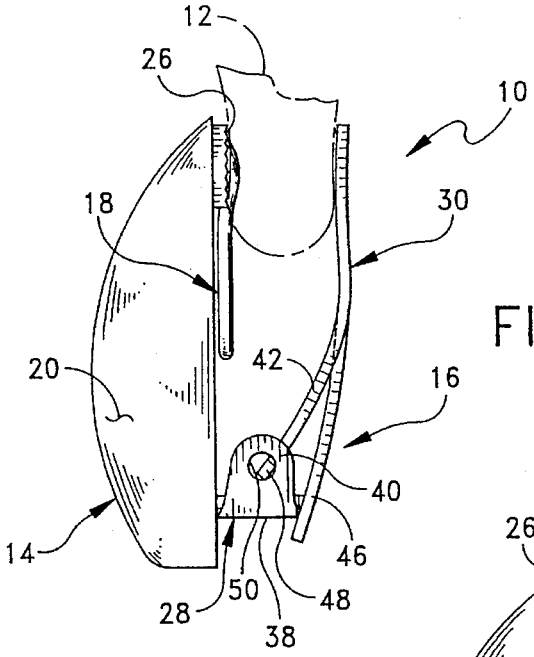
FIG. 2 is a side elevational view thereof illustrating the earring being worn as a clip-on earring on an earlobe which is illustrated in broken lines.

FIG. 2 illustrates the earring 10 of the present invention being worn on the earlobe 10 as a clip-on type earring. As illustrated, the post 18 is in its stowed position in which it is seated in the groove 62 formed in the earlobe engaging member 26 of the ornament 14. The clip portion 30 of the clamping assembly 16 is in its clamping position in which the earlobe 12 of the wearer is positioned between the clip portion 30 and the earlobe engaging member 26. The clip portion 30 is spring biased against the earlobe 12 and the earlobe engaging member 26 is provided with ridges 54 so as to assist in preventing the earring 10 from slipping off the wearer's earlobe 12.

Figure 3:
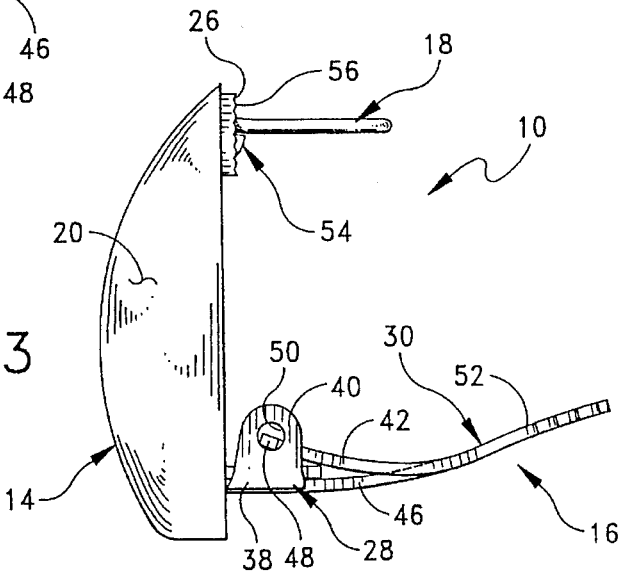
FIG. 3 is a side elevational view similar to FIG. 2, a clip and a post of the earring being illustrate in open positions.
Figure 4:
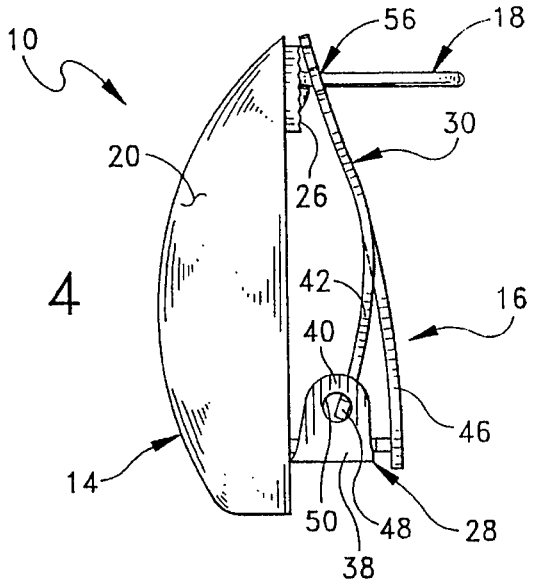
FIG. 4 is a view similar to FIGS. 2 and 3 in which the earring is adapted to be worn on a pierced ear.
Figure 5:
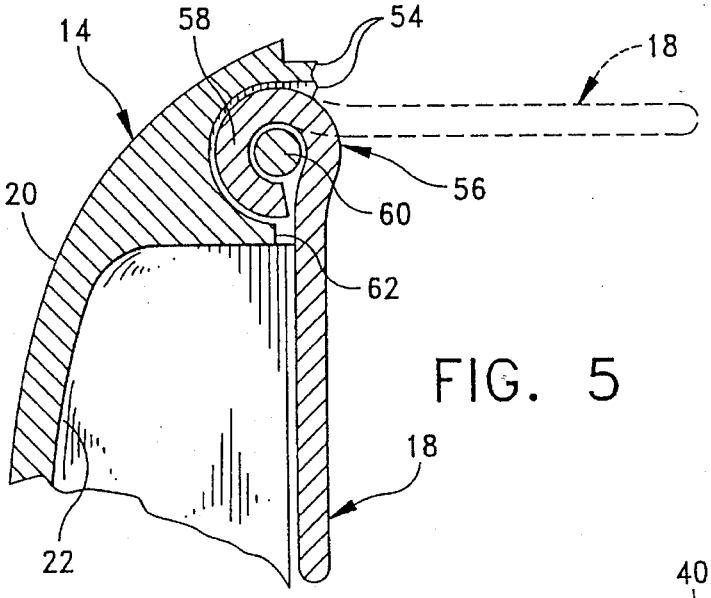
FIG. 5 is an enlarged sectional view taken along line 5—5 of FIG. 1.

FIGS. 3–8 illustrate the earring 10 in its pierced earring mode in which the post 18 of the earring 10 may be inserted through a pierced opening in the wearer's lobe. As illustrated in FIG. 3, the clip portion 30 is moved towards its open position, and the post 18 is moved to its use position. The post 18 is then inserted through the pierced opening in the wearer's earlobe 12 in the conventional fashion. The clip portion 30 of the clamping assembly 16 is then moved to its clamping position much in the same manner as when the earring is being worn as a clip-on earring. The opening 64 in the clip portion 30 receives the terminal end of post 18 for preventing the removal of the earring 10 from the pierced earlobe 12 of the wearer.

Thus, it will be observed that the convertible earring 10 of the present invention is capable of being easily converted between a clip-on earring and a pierced earring without having to mount or assemble any separate pieces onto the earring as is the case with the prior art of which applicant is aware.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An earring capable of being converted from a clip-on earring to a pierced earring and vice versa, said earring comprising:

an ornament having an outer periphery defining an inwardly facing surface which is adjacent an earlobe of a wearer when the earring is worn, said inwardly facing surface being concave so as to define a cavity;

a clamping assembly for clamping the earring on the earlobe of the wearer, said clamping assembly being pivotally attached to the inwardly facing concave surface of the ornament at a first point adjacent the periphery thereof, and comprising a clip portion pivotally movable between an open position and an earlobe clamping position in which the earlobe of the wearer is positioned between the clip portion and the inwardly facing surface of the ornament, and spring means for biasing the clip portion toward the ornament when the clip portion is in its earlobe clamping position for providing a clamping force so that the earring remains attached to the earlobe when worn;

an earlobe engaging member mounted on said inwardly facing concave surface at a second point adjacent the periphery of said ornament generally diametrically opposed to said first point, with the major portion of said engaging member located within said cavity; and a post pivotally mounted on said engaging member, said post being pivotally movable between a stowed position in which the post lies flat adjacent to and generally parallel to said ornament and extends toward said first point but terminates short thereof so that said post is located within said ornament periphery, and a use position in which the post extends generally perpendicularly from said ornament for insertion through a pierced opening in the wearer's earlobe, the clip portion being movable toward its earlobe clamping position for engaging the free end of the post.

* * * * *